US010575604B2

(12) United States Patent
Kimbrough et al.

(10) Patent No.: US 10,575,604 B2
(45) Date of Patent: Mar. 3, 2020

(54) TRANSFORMABLE JEWELRY AND DECORATIVE STRUCTURES

(71) Applicants: Richard R. Kimbrough, Sante Fe, NM (US); Robert Schuyler, Toronto (CA); David Fuhrer, Los Angeles, CA (US)

(72) Inventors: Richard R. Kimbrough, Sante Fe, NM (US); Robert Schuyler, Toronto (CA); David Fuhrer, Los Angeles, CA (US)

( * ) Notice: Subject to any disclaimer, the term of this patent is extended or adjusted under 35 U.S.C. 154(b) by 79 days.

(21) Appl. No.: 15/863,658

(22) Filed: Jan. 5, 2018

(65) Prior Publication Data

US 2018/0184768 A1 Jul. 5, 2018

Related U.S. Application Data

(60) Provisional application No. 62/442,600, filed on Jan. 5, 2017.

(51) Int. Cl.

| | |
|---|---|
| ***A44C 25/00*** | (2006.01) |
| ***A44C 15/00*** | (2006.01) |
| ***A63H 33/00*** | (2006.01) |
| ***A63H 3/04*** | (2006.01) |
| *A44C 11/00* | (2006.01) |

(52) U.S. Cl.

CPC ..... *A44C 15/001* (2013.01); *A44C 25/00* (2013.01); *A63H 3/04* (2013.01); *A63H 33/003* (2013.01); *A44C 11/002* (2013.01)

(58) Field of Classification Search

CPC ..... A44C 15/001; A44C 25/00; A44C 11/002; A44C 11/00; A44C 13/00; A44C 11/007; A63H 33/003; A63H 3/04

USPC ..... 63/1.16, 1.17, 41, 38; 446/99

See application file for complete search history.

(56) References Cited

U.S. PATENT DOCUMENTS

| | | | | |
|---|---|---|---|---|
| 434,302 | A * | 8/1890 | Senner | A45C 5/08 63/38 |
| 878,123 | A * | 2/1908 | Costello | A44C 11/002 63/38 |
| 1,325,651 | A | 12/1919 | Pajeau | |

(Continued)

FOREIGN PATENT DOCUMENTS

WO WO2005076901 A2 8/2005

*Primary Examiner* — Jack W Lavinder

(74) *Attorney, Agent, or Firm* — Millman IP Inc.

(57) ABSTRACT

A transformable structure reconfigurable between in-line and simulative configurations. Head beading, an anterior engaging bead, anterior appendage beading, a central bead, posterior appendage beading, a posterior engaging bead, and terminal beading are connected in series. The central bead has anterior and posterior cavities, and receivable portions of the engaging beads are respectively received in the cavities when the structure is in the simulative configuration. An elastic core passes through the beading, and the transformable structure can be reconfigured between in-line and simulative configurations by a relative twisting and untwisting of the components. The anterior and posterior engaging beads can be spherical, and the anterior and posterior cavities can be hemispherical. An anterior toroidal ring bead between the head beading and the anterior engagement bead and a posterior toroidal ring bead between the terminal beading and the posterior engaging bead facilitate selective repositioning of the head and terminal beading.

22 Claims, 8 Drawing Sheets

(56) References Cited

U.S. PATENT DOCUMENTS

| | | | | |
|---|---|---|---|---|
| 2,942,318 | A * | 6/1960 | Stafford | A44C 11/002 24/574.1 |
| 3,190,086 | A | 6/1965 | Klein | |
| 3,526,103 | A | 9/1970 | Lieber | |
| 3,597,872 | A | 8/1971 | Vennola et al. | |
| 3,745,694 | A | 7/1973 | Vennola | |
| 3,983,716 | A | 10/1976 | Kuhn | |
| 4,305,582 | A | 12/1981 | Barton | |
| 4,362,031 | A | 12/1982 | Obermuller | |
| 4,581,904 | A | 4/1986 | Lehmann et al. | |
| 4,722,712 | A | 2/1988 | McKenna | |
| 4,738,648 | A | 4/1988 | Berndt | |
| 4,879,882 | A | 11/1989 | Johnson et al. | |
| 4,997,375 | A | 3/1991 | Heinz | |
| 5,302,148 | A | 4/1994 | Heinz | |
| 5,906,846 | A | 5/1999 | Coleman et al. | |
| 6,241,572 | B1 | 6/2001 | Braginsky | |
| 6,264,522 | B1 * | 7/2001 | Dickson | A44C 13/00 446/102 |
| 6,482,063 | B1 | 11/2002 | Frigard | |
| 6,789,395 | B2 | 9/2004 | Molino et al. | |
| 7,354,330 | B2 | 4/2008 | Bentley, Jr. | |
| 2010/0221975 | A1 | 9/2010 | Kimbrough | |
| 2012/0324946 | A1 * | 12/2012 | Latouf | A44C 13/00 63/1.13 |

* cited by examiner

TRANSFORMABLE JEWELRY AND DECORATIVE STRUCTURES

RELATED APPLICATION

This application claims priority to U.S. Provisional Application No. 62/442,600, filed Jan. 5, 2017, which is incorporated herein by reference.

FIELD OF THE INVENTION

The present invention relates generally to jewelry and decorative structures. More particularly, disclosed herein are articles of jewelry and other decorative structures that are transformable between a first configuration for use as a necklace, a bracelet, or other article and a second configuration simulative of an animal, person, or other structure.

BACKGROUND OF THE INVENTION

Playing with educational toys, particularly reconfigurable toys, aids in developing a child's ability to think, focus, and appreciate the value of patience and creativity. Equally importantly, children and adults alike enjoy playing with character-shaped toys and reconfiguring toys between various configurations. Configuring and reconfiguring characters and other shapes provokes the imagination of the user and yields great play value. Furthermore, character-shaped toys are great tools for enabling children to learn animal names, body parts, and other characteristics.

It is also well recognized that owning and wearing jewelry, which is normally a very different matter from playing with toys, is enjoyable to individuals of all ages. Wearing jewelry accessorizes the appearance of the wearer and can improve one's appreciation for the artistic value of various types of jewelry.

The present inventors, being aware of the foregoing, appreciated that jewelry would be enhanced educationally and would be rendered still more enjoyable to children and even adults if the jewelry could be mutually transformable between a character-shaped toy and an article of jewelry, such as a necklace, bracelet, or anklet. A person using his or her hands to accomplish such a transformation from a character-shaped toy to an article of jewelry can develop fine motor skills. Moreover, reconfiguring articles between jewelry and character-shaped configurations can improve the user's understanding of structural relationships between movable components.

It is recognized that numerous reconfigurable structures have been disclosed by the prior art, including by one of the present inventors. The inventors' particular knowledge in the field of reconfigurable articles has accentuated that the need remains for improved structures that can be reconfigured between a first configuration, such as a first, in-line configuration that could be used as a bracelet, necklace, or other article, and a second configuration, such as a configuration simulative of an animal, person, or other structure.

By way of example and not limitation, the art would be advanced by such a reconfigurable structure that is easily reconfigured between the first and second configurations while stably maintaining the configurations against inadvertent dislodging. Moreover, there is a need for a reconfigurable article that, when in the second configuration simulative of an animal, person, or other structure, can be readily posed to various positions for the entertainment and enjoyment of the user. Still further, there is a known need in the art for a reconfigurable article that, when in the second configuration simulative of an animal, person, or other structure, accurately simulates the shape of the intended creature or other structure.

SUMMARY OF THE INVENTION

Accordingly, the present invention was founded on the basic object of providing a structure that can be transformed between a first configuration, such as one in which the structure can be worn as jewelry, and a second configuration that simulates the shape of an animal, person, or other structure.

An underlying object of the invention is to provide a reconfigurable article that can be repositioned between the first and second configurations easily while maintaining stability against inadvertent dislodging.

Another object of the invention is to provide a reconfigurable article that, while in a configuration simulative of a person, animal, or other structure, can be readily posed to various positions.

Still another object of the invention is to provide a reconfigurable article that provides an accurate simulation of an intended creature or other structure when in a simulative configuration.

These and in all likelihood further objects and advantages of the present invention will become obvious not only to one who reviews the present specification and drawings but also to those who have an opportunity to make use of the transformable jewelry and decorative structures disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more of the foregoing objects, one embodiment of the transformable structure, which is reconfigurable from an in-line configuration to a simulative configuration, has a plurality of components connected in series. The plurality of components comprise, in order when the transformable structure is in the in-line configuration, head beading, an anterior engaging bead, anterior appendage beading, a central bead, posterior appendage beading, a posterior engaging bead, and terminal beading. The terminal beading could, for example, comprise simulative tail beading.

The central bead has an anterior cavity and a posterior cavity. The central bead can be considered to have a longitudinal, and the anterior and posterior cavities are longitudinally aligned with that longitudinal. The anterior engaging bead has a receivable portion that is received in the anterior cavity of the central bead when the transformable structure is in the simulative configuration, and the posterior engaging bead has a receivable portion that is received in the posterior cavity of the central bead when the transformable structure is in the simulative configuration. The transformable structure is thus stably maintained in the simulative configuration by an engagement between the engaging beads and the cavities in the central bead.

The head beading, the anterior engaging bead, the anterior appendage beading, the central bead, the posterior appendage beading, the posterior engaging bead, and the terminal beading can have through-holes. A core member, such as an elastic core member, passes through the through-holes to connect the plurality of components in series.

In certain embodiments of the transformable structure, the receivable portion of the anterior engaging bead has a size and shape corresponding to a size and shape of a reception volume defined by the anterior cavity in the central bead. Similarly, the posterior engaging bead has a receivable portion with a size and shape corresponding to a size and shape of a reception volume defined by the posterior cavity in the body bead. For instance, the receivable portions of the anterior and posterior engaging beads can be substantially hemispherical, and the reception volumes defined by the anterior and posterior cavities in the central bead can be substantially hemispherical. The anterior and posterior engaging beads can, for example, be substantially spherical with the reception volumes defined by the anterior and posterior cavities in the central bead being substantially hemispherical.

To permit the transformable structure to be formed into a loop when in an in-line configuration, a first fastening mechanism can be retained by the head beading and a second fastening mechanism can be retained by the terminal beading. Any effective type of fastening mechanism would be possible.

In manifestations of the invention, such as where the transformable structure simulates a real or imaginary being, the anterior appendage beading can comprise first and second simulative arms or legs retained in series. In a similar manner, the posterior appendage beading can take the form of first and second simulative legs retained in series.

Embodiments of the transformable structure can additionally include an anterior toroidal ring bead interposed between the head beading and the anterior engaging bead when the transformable structure is in the in-line configuration and a posterior toroidal ring bead interposed between the terminal beading and the posterior engaging bead when the transformable structure is in the in-line configuration. Particularly where the anterior and posterior engaging beads are substantially spherical, the anterior and posterior toroidal ring beads can be readily repositioned in relation to the respective engaging beads when the transformable structure is in the simulative configuration. Consequently, the head beading and the terminal beading, such as tail beading, can be selectively repositioned to permit the transformable structure to be adjusted to different poses.

Still further, embodiments are contemplated where the head beading, the anterior engaging bead, the anterior appendage beading, the central bead, the posterior appendage beading, the posterior engaging bead, and the terminal beading have through-holes and a core member passes through the through-holes to connect the plurality of components in series and where the through-hole in the head beading terminates in a conical portion. In such constructions, a key member can be included with a cap portion that spans the conical portion and a central rod portion that projects from the cap portion toward the through-hole in the head beading.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The transformable jewelry and other decorative structures disclosed herein can pursue a variety of embodiments within the scope of the invention. However, to ensure that one skilled in the art will be able to understand and, in appropriate cases, be enabled to practice the invention, certain preferred embodiments of the broader invention revealed herein are described below and shown in the accompanying drawing figures.

Figure 1:
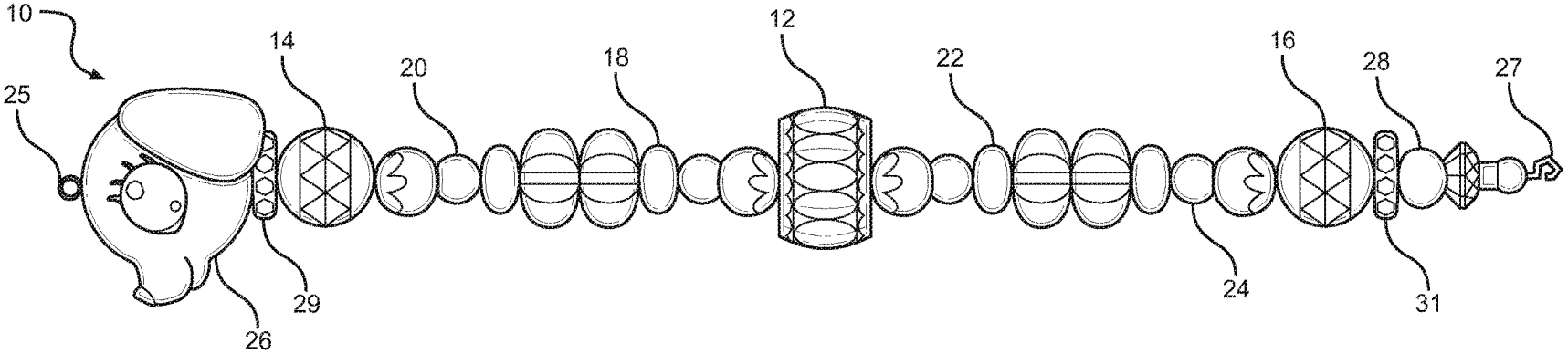
FIG. 1 is a view in side elevation of a transformable structure according to the present invention in an in-line configuration.

A transformable structure according to the invention is indicated generally at 10 in FIGS. 1 through 9. In FIG. 1, the transformable structure 10 is in what can be considered an in-line configuration with a first end 26 and a second end 28. When in an in-line configuration, the transformable structure 10 can be formed into a loop, such as by coupling the first and second ends. With that, the transformable structure 10 can be worn as a necklace, bracelet, anklet, ring, or the like.

A first fastening mechanism 25 can be disposed at the first end 26 of the transformable structure 10, and a second fastening mechanism 27 can be disposed at the second end 28 of the transformable structure 10 for selectively coupling to the first fastener 25 is disposed at the first end 26 of the transformable structure 10. The first and second fastening mechanisms 25 and 27 can be of any effective type, such as a lobster claw style clasp in combination with a ring, a barrel clasp, a hook & eye clasp as illustrated in FIG. 1, a magnetic clasp, a spring ring clasp, or any other effective clasping, fastening, or coupling means. Each and further fasteners are within the scope of the invention. The first and second fasteners 25 and 27 are specifically indicated in FIGS. 1 and 2 with it being understood that first and second fasteners 25 and 27 or other clasping, coupling, or fastening means may be incorporated in each embodiment of the transformable structure 10.

Figure 2:
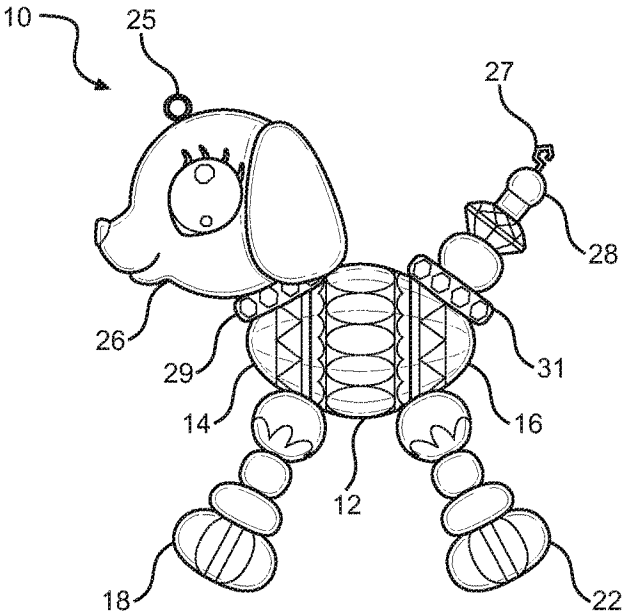
FIG. 2 is a view in side elevation of the transformable structure transformed into a configuration simulative of an animal.

As taught herein, the transformable structure 10 can be reconfigured to a second configuration as in FIG. 2. There, the transformable structure 10 simulates a dog. It will be understood that numerous other structures could be simulated. Without limitation, for example, the transformable structure 10 could be crafted to simulate human beings, other types of animals, imaginary creatures, robots, and non-living structures within the scope of the invention except as it may be expressly limited by the claims.

Where the transformable structure 10 is designed to simulate a being as in FIGS. 1 and 2, the transformable structure 10 can be considered to be founded on plural components that are retained in series along an elastic core 30. A first end of the elastic core 30 has a first end secured relative to the component 26 forming the first end of the structure 10 and a second end secured relative to the component 28 forming the second end of the structure 10. The components intermediate to the components 26 and 28 have apertures therethrough that slidably receive the elastic core 30.

In the depicted embodiment, the first end component 26 comprises a head bead 26, and the second end component 28, which may alternatively be referred to as terminal beading 28, comprises a tail bead or beading 28. The transformable structure 10 has a centrally disposed body bead 12. First and second anterior appendage beading 18 and 20, which here comprises left and right leg beading 18 and 20, is disposed in series along the elastic core 30 between the body bead 12 and the head bead 26 with the first anterior appendage beading 18 adjacent to the body bead 12 and the second anterior appendage beading 20 adjacent to the first anterior appendage beading 18. Each of the first and second anterior appendage beading 18 and 20 can be formed from a single, unitary structure, which could be crafted to appear as plural beads or as a single piece. Alternatively, the first and second anterior appendage beading 18 and 20 could be formed from plural separate beads. Anterior engaging beading 14, which can be unitary as in the depicted embodiment or could comprise plural separate beads, is disposed along the elastic core 30 between the head bead 26 and the second anterior appendage beading 20.

In a similar manner, first and second posterior appendage beading 22 and 24, which here comprises left and right leg beading 22 and 24, is disposed in series along the elastic core 30 between the body bead 12 and the tail bead 28 with the first posterior appendage beading 22 adjacent to the body bead 12 and the second posterior appendage beading 24 adjacent to the first posterior appendage beading 22. Each of the first and second posterior appendage beading 22 and 24 can be formed from a single, unitary structure, which could be crafted to appear as plural beads or as a single piece, or the first and second posterior appendage beading 22 and 24 could be formed from plural separate beads. Posterior engaging bead 16, which can be unitary as in the depicted embodiment or could comprise plural separate beads, is disposed along the elastic core 30 between the tail bead 26 and the second posterior appendage beading 24.

Each of the components 12, 14, 16, 18, 20, 22, 24, 26, and 28 forms a portion of the necklace, bracelet, or other article when the structure 10 is in an in-line configuration. Each component 12, 14, 16, 18, 20, 22, 24, 26, and 28 also forms a predetermined portion of the simulative structure, in this example a dog, to which the transformable structure 10 can be reconfigured.

Further or potentially fewer components can be included. In one non-limiting example, as is illustrated, a toroidal ring bead 29, which can simulate a neck, a collar, or other element, is interposed between the anterior engaging bead 14 and the head bead 26. Furthermore, a toroidal ring bead 31 is interposed in the depicted embodiment between the posterior engaging bead 16 and the tail beading 28. Each of the components 12, 14, 16, 18, 20, 22, 24, 26, and 28 could be formed unitarily or from plural beads, which could be fixed together or loosely juxtaposed.

Where the structure 10 is crafted to simulate a living being, the central body portion bead 12, alternatively referred to as the central bead 12, is predetermined and specifically shaped to form a some or all of a simulated trunk, torso, thorax, or other central body portion. The tail bead or beading 28 is shaped and located to form a simulated tail or other complementary body portion when the structure 10 is in the simulative configuration. The first and second anterior appendage beading 18 and 20 simulates left and right front legs or the arms of the simulative figure, and the first and second posterior appendage beading 22 and 24 simulates left and right legs, such as the rear legs of a four-legged creature or the legs of a two-legged creature. When configured for simulating a creature, the anterior engaging beading 14 can be simulative of, for example, some or all of the chest and shoulders of the creature and the posterior engaging beading 16 can be simulative of, for example, some or all of the lower torso, the crotch, and, additionally or alternatively, the bottom of the creature.

It is possible for a given component to be formed with multiple parts. For example, the head beading 26 could have a first portion forming a neck, a second portion forming a face, first and second ears projecting from the face, and structures simulating a nose, eyes, and other features. Fasteners 25 and 27 of any effective type could be disposed at the tips of the head beading 26 and the tail beading 28 to permit the formation of the transformable structure 10 into a loop as desirable for acting as a bracelet, necklace, or other looped article.

The elastic core 30 can be of any suitable type and shape. For example, the elastic core 30 could be a single member or a multiplicity of members disposed in series or in parallel. It would also be possible for some or all of the components to be sequentially coupled by separate elastic members. Of course, any variation from a single elastic core 30, to multiple separate members, or some other arrangement is possible. The elastic core 30 or core members could in any case have a round cross section, a rectangular cross section, or any other cross section. The elastic core 30 or the individual members could be formed from any suitable material or combination of materials but will preferably demonstrate sufficient resilience, durability, and abrasion resistance to permit the transformable structure 10 to be reconfigured through a large number of cycles.

Likewise, the components 12, 14, 16, 18, 20, 22, 24, 26, and 28 can be made of any suitable material or combination of materials, including wood, plastic, and metal. The components 12, 14, 16, 18, 20, 22, 24, 26, and 28, particularly the components 12, 14, 16, 18, 20, 22, and 24 not forming ends of the structure 10, can be beads. Longitudinal through-holes through the beads could be formed in any effective manner, whether by initial molding, drilling, or otherwise. The components 12, 14, 16, 18, 20, 22, 24, 26, and 28 can be differently sized, shaped, and colored to predesignate them as their relative body parts, and additional beads or other elements could be incorporated to aid in the simulation of the desired thing or otherwise to improve the appearance of the structure 10.

For example, to better simulate a giraffe, additional beads can be interposed between the head 26 and the anterior leg beading 18 and 20 to resemble the long neck of a giraffe. To simulate a sausage dog, smaller beads can be employed for the leg beading 16, 18, 20 and 22 to resemble the short legs specific to that dog, and a longer bead or beads can be employed for the central bead 12 to simulate the long body of the dog. An alligator can be formed with a number of additional beads incorporated into the tail beading 28, and a longer bead or beads forming the head beading 26. A kangaroo has short front leg beading 18 and 20, long posterior leg beading 22 and 24, and a tail 28 that can employed in combination with the posterior leg beading 22 and 24 to permit a triangular support base to be formed. A lion can have head beading 26 formed by a broader bead half simulating a mane proximal to a narrower bead half simulating a face. Horses can be formed with specifically shaped tail beading 28 and head beading 26 with an angled neck portion interposed between it and the leg. Still further, an elephant can be formed with a stout central bead 12 and a plurality of beads retained distal to the bead beading 26 to form a trunk.

It may also be possible to form embodiments of the transformable structure 10 with non-elastic couplings between the components 12, 14, 16, 18, 20, 22, 24, 26, and 28. For example, the transformable structure 10 could take the form of a stuffed animal with the components 12, 14, 16, 18, 20, 22, 24, 26, and 28 retained in series and connected by a strand of material running therethrough or by separate strands or segments of material, which may or may not be resilient. The components 12, 14, 16, 18, 20, 22, 24, 26, and 28 of a stuffed animal transformable structure 10 could be stuffed or otherwise formed in any manner employed for components of stuffed animals of the prior art.

Figure 3:
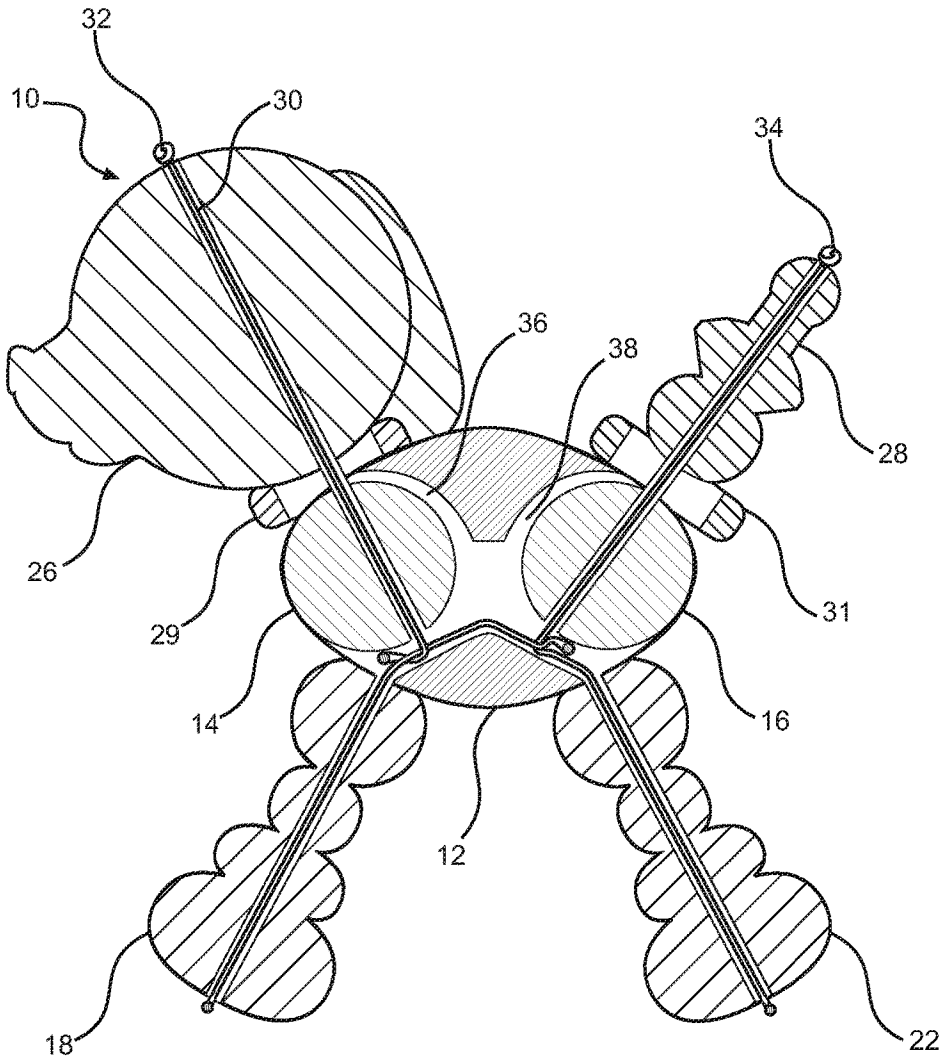
FIG. 3 is a cross-sectional view in side elevation of the transformable structure in a simulative configuration.
Figure 4:
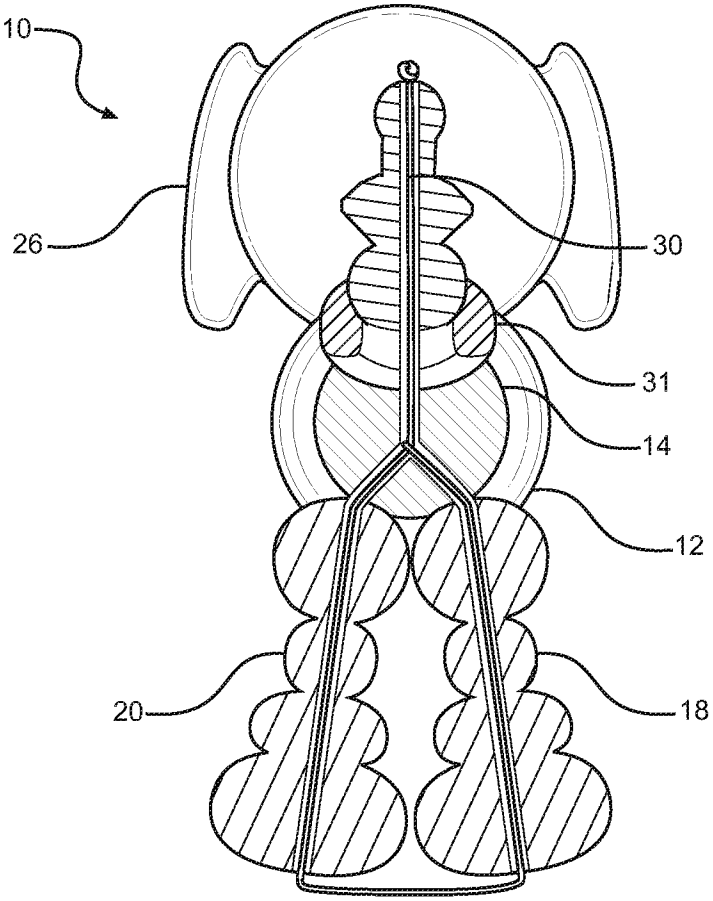
FIG. 4 is a cross-sectional view in rear elevation of the transformable structure in a simulative configuration.

With additional reference to FIGS. 3 and 4, the central bead 12 has an anterior cavity 36 facing toward the head bead 26 and the first and second anterior leg beading 18 and 20, and the body bead 12 has a posterior cavity 38 facing toward the tail bead 28 and the first and second posterior leg beading 22 and 24. The anterior and posterior cavities 36 and 38 are longitudinally aligned with a longitudinal of the central bead 12 and the elastic core 30 when the structure 10 is in an in-line configuration. The cavities 36 and 38 in the central bead 12 are sized and shaped in correspondence to the size and shape of a receivable portion of the anterior and posterior engaging beading 14 and 16, respectively. In this embodiment, the anterior and posterior engaging beading 14 and 16 comprise spherical beads with hemispherical receivable portions, and the cavities 36 and 38 comprise hemispherical bowls for cupping the hemispherical receivable portions of the anterior and posterior engaging beading 14 and 16 when the structure 10 is in the simulative configuration of, for example, FIGS. 2 and 3. The cavities 36 and 48 comprise negative shapes or depressions, and the anterior and posterior engaging beading 14 and 16 have receivable portions that comprise positive shapes or protuberances corresponding in shape and size to the shapes and sizes of the cavities 36 and 38 to be receivable therein.

The anterior and posterior cavities 36 and 38 and the anterior and posterior engaging beading 14 and 16 could pursue other shapes within the scope of the invention. In this preferred embodiment, the anterior and posterior engaging beading 14 and 16 are generally spherical with hemispherical receivable portions, and the anterior and posterior cavities 36 and 38 are generally hemispherical. Other corresponding shapes of the cavities 36 and 38 and the receivable portions of the anterior and posterior engaging beading 14 and 16 are possible within the scope of the invention except as it might be expressly limited by the claims. Under this construction, most particularly when the structure 10 is in a simulative configuration as in FIGS. 2 and 3, the receivable portion of the anterior engaging beading 14 can be matingly received and retained by the anterior cavity 36, and the receivable portion of the posterior engaging beading 16 can be matingly received and retained by the posterior cavity 38.

Transforming of the structure 10 from the in-line configuration of, for example, FIG. 1 to the simulative configuration of, for instance, FIGS. 2 through 4 can begin with a user bending the structure 10, such as by gripping the head beading 26, so that the anterior engaging bead 14 overlies the central bead 12 with the interposed anterior leg beading 18 and 20 exposed projecting beyond the anterior engaging bead 14 and the central bead 12. The anterior leg beading 18 and 20 can then be twisted, such as in a clockwise or counter-clockwise direction, through 180 degrees or more. With that, the elastic core 30 will twist over itself at the junction now formed between the anterior engaging bead 14, the leg beading 18 and 20, and the central bead 12. By the complementary shapes of the receivable portion of the anterior engaging bead 14 and the cavity 36 in the central bead 12 in combination with the resiliency of the elastic core 30, the receivable portion of the anterior engaging bead 14 is automatically pulled into mating engagement with the cavity 36 in the central bead 12. The components 12, 14, 18, 20, and 26 are stably retained in position by the synergistic effects of the corresponding shapes of the anterior engaging bead 14 and the anterior cavity 36 and the resiliency of the core 30. Nonetheless, the components 12, 14, 18, 20, and 26 can be readily reconfigured to an in-line configuration, such as simply by pulling on the head beading 26.

In a similar manner, to form the posterior portion of the simulative figure, the structure 10 can be folded over, such as by gripping the tail beading 28, to cause the posterior engaging bead 16 to overlie the central bead 12 with the interposed posterior leg beading 22 and 24 exposed projecting beyond the posterior engaging bead 16 and the body bead 12. The posterior leg beading 22 and 24 can then be twisted, such as in a clockwise or counter-clockwise direction, through 180 degrees or more. With that, the elastic core 30 will twist over itself at the junction now formed between the posterior engaging bead 16, the leg beading 22 and 24, and the central bead 12. By the complementary shapes of the receivable portion of the posterior engaging bead 16 and the posterior cavity 38 in the central bead 12 in combination with the resiliency of the elastic core 30, the posterior engaging bead 16 is automatically pulled into mating engagement with the cavity 38 in the central bead 12. The components 12, 16, 22, 24, and 28 are stably retained in position by the synergistic effects of the corresponding shapes and the resiliency of the core 30, but the components 12, 16, 22, 24, and 28 can be quickly reconfigured to an inline configuration, such as by a simple pulling on the tail beading 28.

The central bead 12 in this embodiment is round in cross section and smoothly tapers from a broadest central portion toward the edges of the anterior and posterior cavities 36 and 38. The anterior and posterior engaging beads 14 and 16, which are spherical in this embodiment, have diameters approximately corresponding to the maximum diameters of the anterior and posterior cavities 36 and 38. With that, when the receivable portion of the anterior engaging bead 14 is received and retained by the anterior cavity 36 in the central bead 12 and the receivable portion of the posterior engaging bead 16 is received and retained by the posterior cavity 38 in the central bead 12, a generally continuous surface is formed by the mated central bead 12 and the anterior and posterior engaging beads 14 and 16. With that, the simulation of the trunk or torso of a being can be realistically simulated.

With the transformable structure 10 formed in the simulative configuration, the body parts simulated by the head 26, the tail 28, the central bead 12, the engaging beads 14 and 16, and the legs 18, 20, 22, and 24 can be readily posed with substantially full movement therebetween. In the simulative configuration of the transformable structure 10, the toroidal ring bead 29 is interposed between the head bead 26 and the anterior engaging bead 14, and the toroidal ring bead 31 is interposed between the tail beading 28 and the posterior engaging bead 16. With the engaging beads 14 and 16 being spherical, smooth surfaces of the engaging beads 14 and 16 are presented for sliding movement of the toroidal ring beads 29 and 31 thereover while the proximal portions of the head beading 26 and the tail beading 28 are effectively cupped or cradled by the toroidal ring beads 29 and 31. With that, by sliding the toroidal ring beads 29 and 31 in relation to the engaging beads 14 and 16, the head beading 26 and the tail beading 28 can be readily repositioned and stably maintained.

Figure 5:
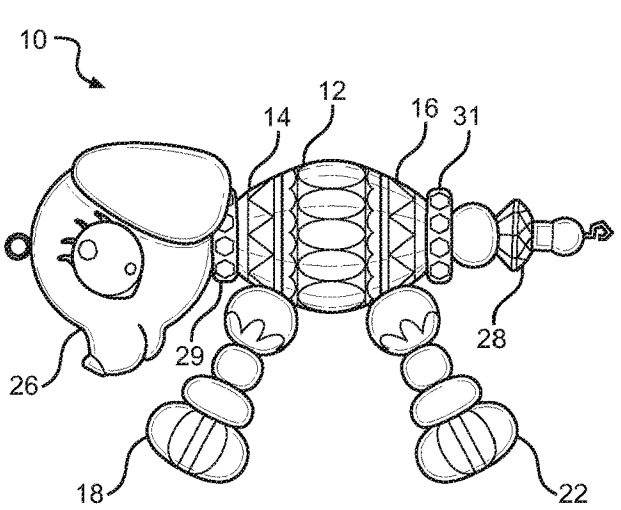
FIGS. 5-9 are views in side elevation of the transformable structure variously posed while in a simulative configuration.
Figure 6:
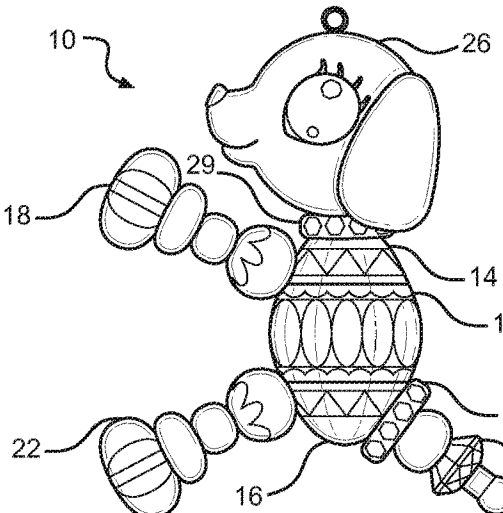
Figure 7:
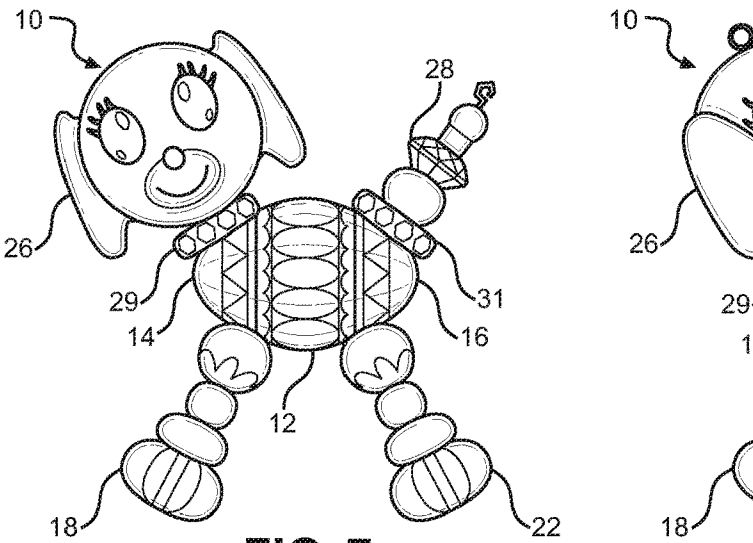
Figure 8:
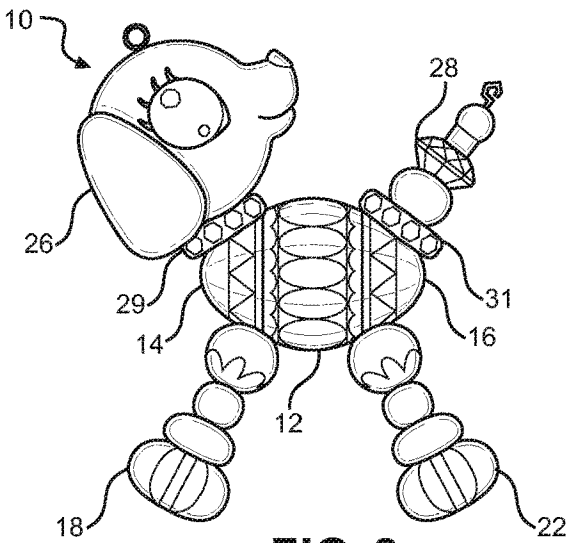
Figure 9:
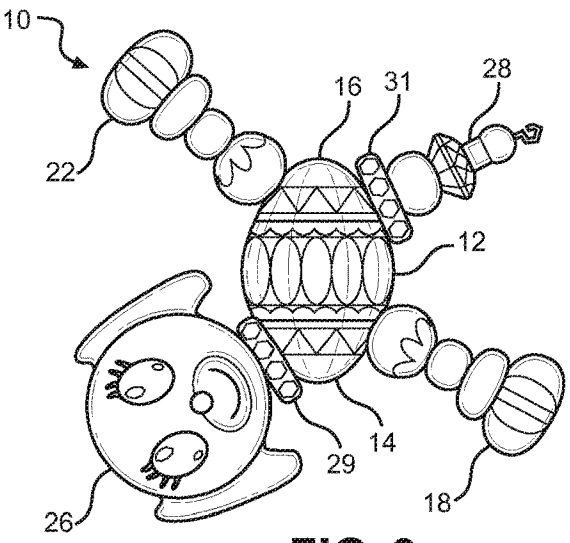

As in FIG. 5, for instance, the structure 10 can be posed to simulate begging with the posterior leg beading 22 and 24 and the tail beading 28 forming a tripod. The structure 10 can be posed to simulate a bad or sad dog with the head and tail beading 26 and 28 bowed as in FIG. 6 or with its head beading 26 variously positioned as in FIGS. 7 and 8 or even in a simulated dance position as in FIG. 9.

Figure 11:
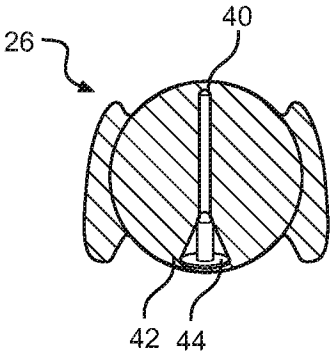
FIG. 11 is a partially sectioned view in front elevation of the head of the transformable structure.
Figure 10:
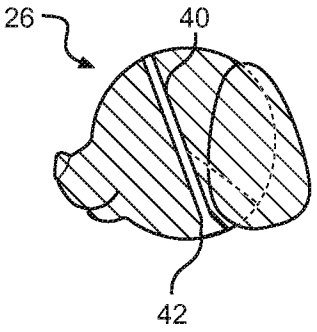
FIG. 10 is a partially sectioned view in side elevation of a head of a transformable structure as taught herein.
Figure 13:
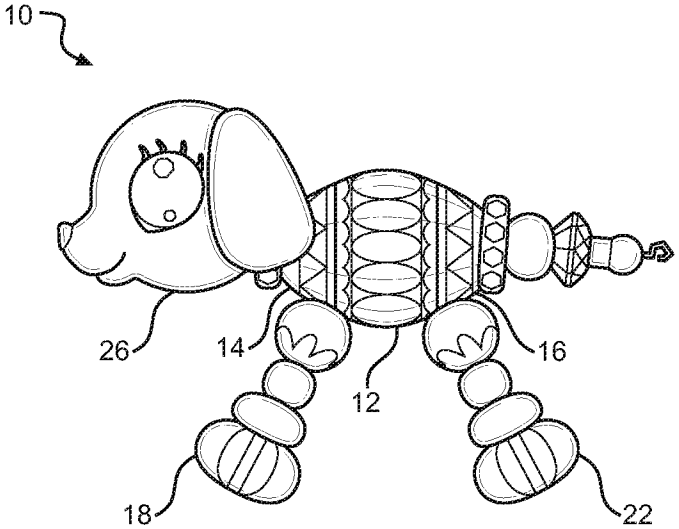
FIGS. 12 and 13 are views in side elevation of the transformable structure variously posed while in a simulative configuration.
Figure 12:
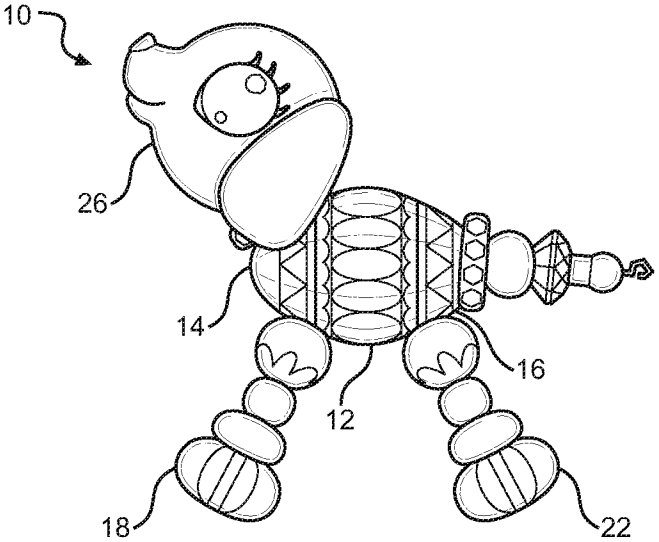

As shown in FIG. 10, the head beading 26 can be formed with a through-hole 40 formed therein. The through-hole 40 has a lower conical portion 42. The lower conical portion 42 is structured for receiving and being occupied by a key 44 as in FIG. 11. The key 44 in this embodiment comprises a member with an annular cap portion that spans the lower conical portion and a central rod portion that projects from the cap portion toward the through-hole 40 in the head beading 40. The structure 10 so provided can permit the head beading 26 to be repositioned, such as to the upward position of FIG. 12 or the pointing position of FIG. 13.

Exploiting the invention, transformable structures 10 can thus be created with varying levels of complexity and detail. Transformable structures 10 are contemplated wherein only two twists are required to convert from the in-line, jewelry configuration of to the simulative configuration. However, more advanced transformable structures 10 are contemplated wherein three or more twists are required to adjust between in-line and simulative configurations.

Figure 14:
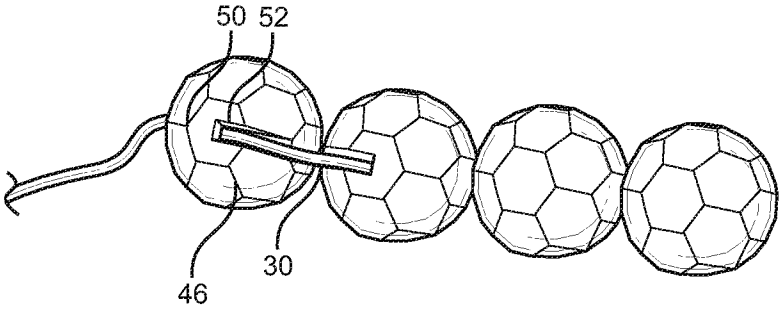

Still further, as shown in FIG. 14, for instance, individual beads 46 could be formed as polyhedrons with plural facets. With this, a positive engagement between beads 46 so formed can be ensured thereby permitting not only the initial disposition of the transformable structure 10 but also adjustable positioning as desired. Varied positioning of the transformable structure 10 can further be enabled by slots 52 radiating from the central through-hole. With that, the elastic core 26 can be selectively caused to enter a given slot to permit extended positioning adjustment.

Figure 15:
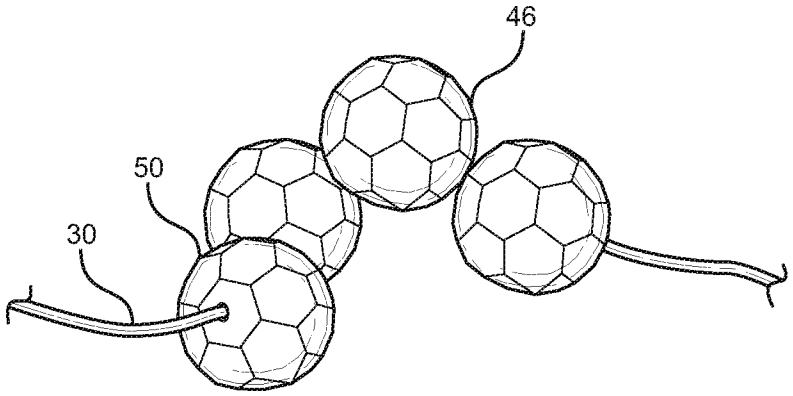
FIGS. 14 and 15 are perspective views of reconfigurable faceted beads as taught herein in different positions.

The positioned polyhedron faceted beads 46 in FIG. 15 illustrate the advantages that may be derived from having positive mechanical engagement between adjacent beads 46 and the positioning that may be achieved by use of slots 52 in the beads 46. In the depicted embodiment, the slots 52 span in one plane over approximately 2 and ½ faceted sides of the beads 46.

Figure 17:
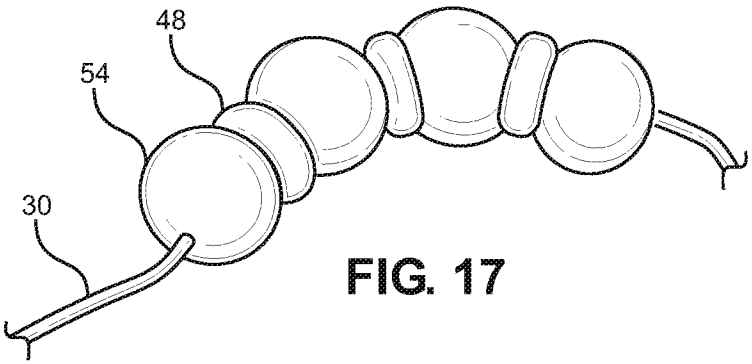
FIG. 17 is a perspective view of the reconfigurable round beads.
Figure 16:
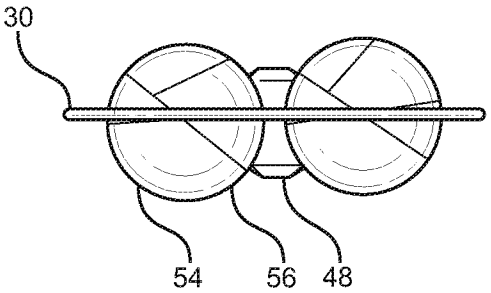
FIG. 16 is a cross-sectional view of reconfigurable round beads as taught herein.
Figure 18:
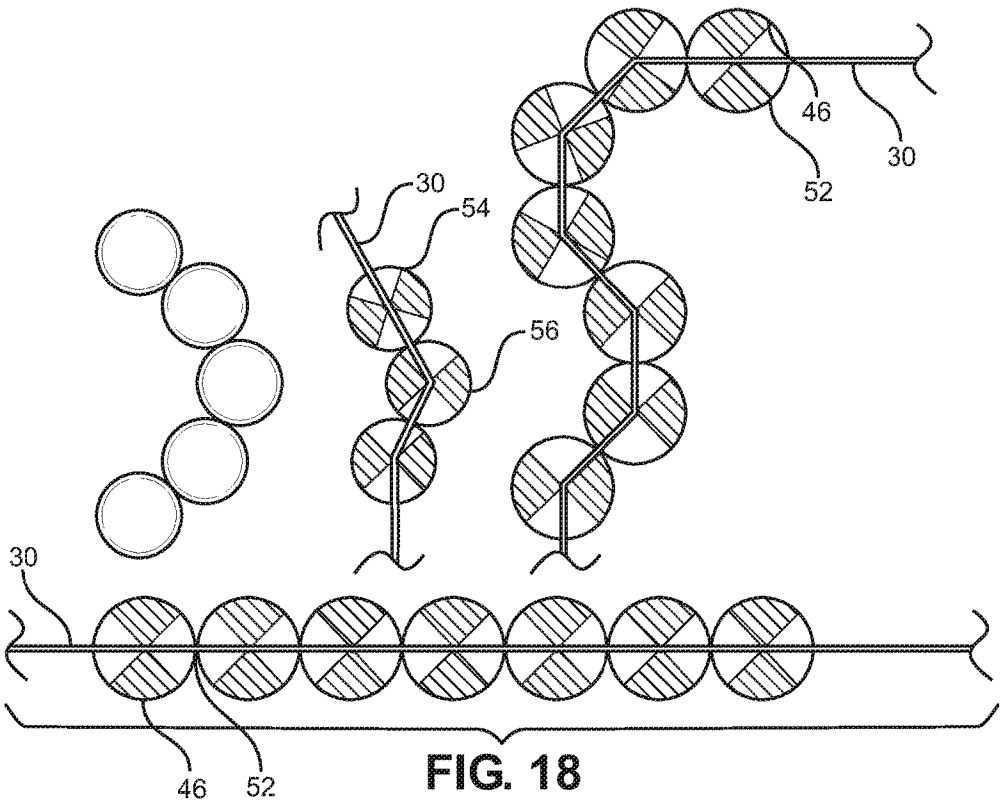
FIG. 18 comprises cross-sectional views of round and faceted beads as disclosed herein.

Looking to FIG. 16, it is contemplated that beads 54, such as round beads, can be provided with conical cavities 56 disposed to radiate from the central through-hole. With that, the beads 54 can be adjustably positioned relative to one another with the elastic core 30 being permitted to pass freely within the conical cavities 56 and thereby to permit enhanced, stable repositioning of several beads 54 retained by the elastic core 30 as in FIGS. 17 and 18.

Figure 20:
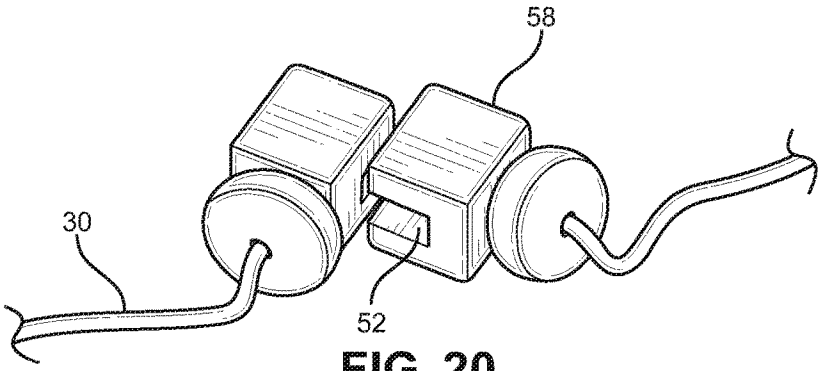
FIG. 20 is a perspective view of the reconfigurable square beads of FIG. 19 in a second position.
Figure 19:
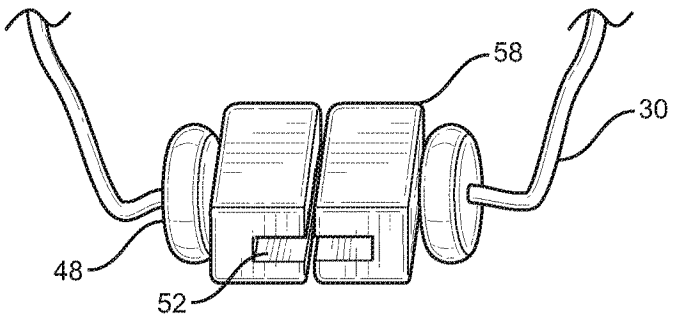
FIG. 19 is a perspective view of reconfigurable square beads as taught herein in a first position.
Figure 23:
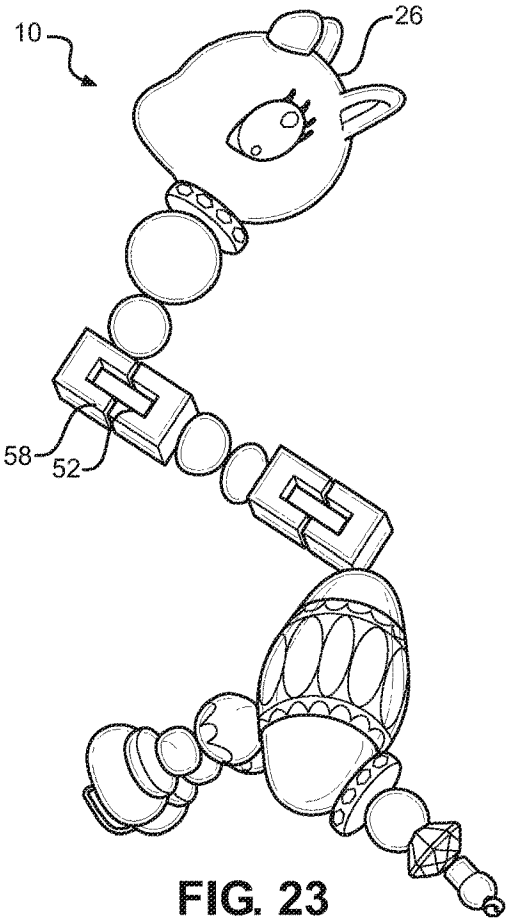
FIG. 23 is a perspective view of the transformable structure of FIG. 21 in another simulative configuration.
Figure 22:
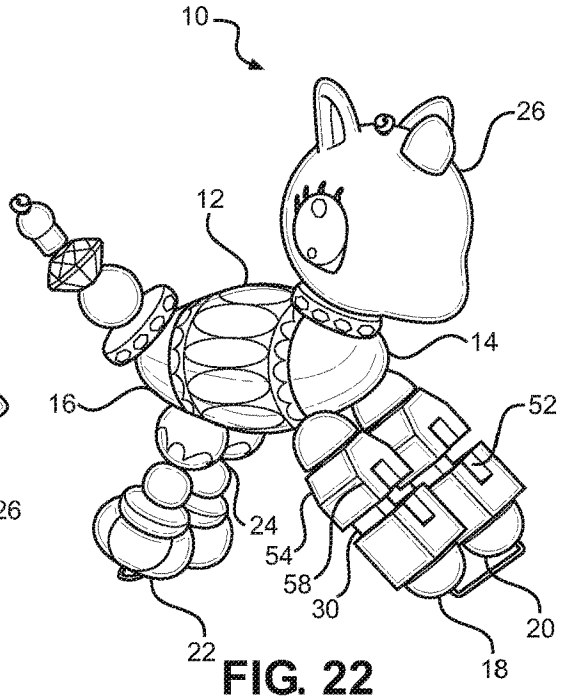
FIG. 22 is a perspective view of the transformable structure of FIG. 21 in a further simulative configuration.
Figure 21:
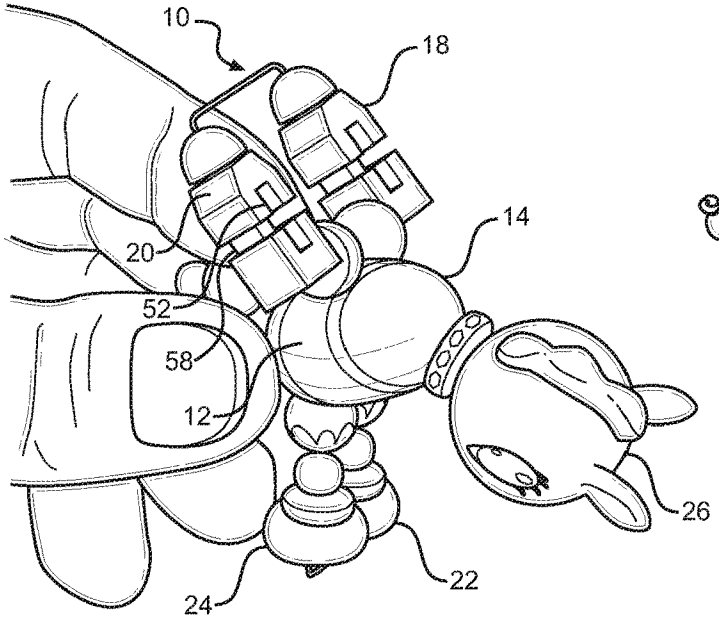
FIG. 21 is a perspective view of a transformable structure as disclosed herein in a simulative configuration.

Turning to FIGS. 19 and 20, beads 58 according to the invention are disclosed that are square. Such beads 58 can form, for instance, portions of the first and second anterior or posterior leg beading 18, 20, 22, and 24 of a finished structure 10 as in FIGS. 21 through 23, for example. The square beads 58 could, for example, form the knees of the structure 10 so that, in conjunction with the force provided by the elastic core 30 in tension, the faces of the square beads 58 can lock the leg beading 18, 20, 22, and 24 in various positions, such as with bended legs as in FIG. 21, straight legs as in FIG. 22, or with the in-line structure 10 variously configured, such as in FIG. 23. To facilitate the positioning, the square beads 58 could have slots 52 formed therein emanating from a central portion of the though-hole through which the elastic core 30 passes. The slots 52 could span, for example, from one lateral face, across an in-line face, and to a second lateral face of the beads 58. With that, the elastic core 30 can be positioned to pass anywhere within the slots 52 to facilitate stable positioning and repositioning of the beads 58 and the structure 10 formed with the beads 58.

With certain details of the present invention for decorative structures that are transformable between a first configuration and a second, simulative configuration disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventors. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, these claims shall be construed to cover not only the corresponding structure and material expressly described in this specification but also all equivalents thereof that might be now known or hereafter discovered.

We claim as deserving the protection of Letters Patent:

1. A transformable structure reconfigurable from an in-line configuration to a simulative configuration, the transformable structure comprising:

a plurality of components connected in series, the plurality of components comprising, in order when the transformable structure is in the in-line configuration, head beading, an anterior engaging bead, anterior appendage beading, a central bead, posterior appendage beading, a posterior engaging bead, and terminal beading;

wherein the central bead has an anterior cavity and a posterior cavity; and wherein the anterior engaging bead has a receivable portion that is received in the anterior cavity of the central bead when the transformable structure is in the simulative configuration and wherein the posterior engaging bead has a receivable portion that is received in the posterior cavity of the central bead when the transformable structure is in the simulative configuration, further comprising at least one ring bead selected from the set of ring beads consisting of:

an anterior toroidal ring bead interposed between the head beading and the anterior engaging bead when the transformable structure is in the in-line configuration, wherein the anterior engaging bead is substantially spherical whereby, when the transformable structure is in the simulative configuration, the anterior toroidal ring bead can be selectively repositioned in relation to the anterior engaging bead; and a posterior toroidal ring bead interposed between the terminal beading and the posterior engaging bead when the transformable structure is in the in-line configuration, wherein the posterior engaging bead is substantially spherical whereby, when the transformable structure is in the simulative configuration, the posterior toroidal ring bead can be selectively repositioned in relation to the posterior engaging bead.

2. The transformable structure of claim 1 wherein the head beading, the anterior engaging bead, the anterior appendage beading, the central bead, the posterior appendage beading, the posterior engaging bead, and the terminal beading have through-holes and further comprising a core member that passes through the through-holes to connect the plurality of components in series.

3. The transformable structure of claim 2 wherein the core member comprises an elastic core member.

4. The transformable structure of claim 1 wherein the receivable portion of the anterior engaging bead has a size and shape corresponding to a size and shape of a reception volume defined by the anterior cavity in the central bead and wherein the posterior engaging bead has a receivable portion with a size and shape corresponding to a size and shape of a reception volume defined by the posterior cavity in the central bead.

5. The transformable structure of claim 4 wherein the receivable portions of the anterior and posterior engaging beads are substantially hemispherical.

6. The transformable structure of claim 5 wherein the reception volumes defined by the anterior and posterior cavities in the central bead are substantially hemispherical.

7. The transformable structure of claim 5 wherein the anterior and posterior engaging beads are substantially spherical.

8. The transformable structure of claim 7 wherein the reception volumes defined by the anterior and posterior cavities in the central bead are substantially hemispherical.

9. The transformable structure of claim 1 further comprising a first fastening mechanism retained by the head beading and a second fastening mechanism retained by the terminal beading.

10. The transformable structure of claim 9 wherein the terminal beading comprises simulative tail beading.

11. The transformable structure of claim 1 wherein the anterior appendage beading comprises first and second simulative legs retained in series and wherein the posterior appendage beading comprises first and second simulative legs retained in series.

12. The transformable structure of claim 1 wherein the anterior engaging bead is substantially spherical whereby, when the transformable structure is in the simulative configuration, the anterior toroidal ring bead can be selectively repositioned in relation to the anterior engaging bead.

13. The transformable structure of claim 1 wherein the posterior engaging bead is substantially spherical whereby, when the transformable structure is in the simulative configuration, the posterior toroidal ring bead can be selectively repositioned in relation to the posterior engaging bead.

14. The transformable structure of claim 1 wherein the central bead has a longitudinal axis that passes through the anterior cavity and the posterior cavity and wherein the anterior and posterior cavities are longitudinally aligned with the longitudinal axis.

15. The transformable structure of claim 1 wherein the receivable portions of the anterior and posterior engaging beads are substantially hemispherical.

16. The transformable structure of claim 15 wherein the reception volumes defined by the anterior and posterior cavities in the central bead are substantially hemispherical.

17. The transformable structure of claim 16 wherein the anterior and posterior engaging beads are substantially spherical.

18. A transformable structure reconfigurable from an in-line configuration to a simulative configuration, the transformable structure comprising:

a plurality of components connected in series, the plurality of components comprising, in order when the transformable structure is in the in-line configuration, head beading, an anterior engaging bead, anterior appendage beading, a central bead, posterior appendage beading, a posterior engaging bead, and terminal beading wherein the head beading, the anterior engaging bead, the anterior appendage beading, the central bead, the posterior appendage beading, the posterior engaging bead, and the terminal beading have through-holes;

a core member that passes through the through holes to connect the plurality of components in series;

wherein the central bead has an anterior cavity and a posterior cavity, wherein the anterior cavity defines a substantially hemispherical cavity, and wherein the posterior cavity defines a substantially hemispherical cavity; and wherein the anterior engaging bead is substantially spherical and is received by the anterior cavity of the central bead when the transformable structure is in the simulative configuration and wherein the posterior engaging bead is substantially spherical and is received by the posterior cavity of the central bead when the transformable structure is in the simulative configuration.

19. The transformable structure of claim 18 further comprising an anterior toroidal ring bead interposed between the head beading and the anterior engaging bead when the transformable structure is in the in-line configuration.

20. The transformable structure of claim 18 further comprising a posterior toroidal ring bead interposed between the terminal beading and the posterior engaging bead when the transformable structure is in the in-line configuration.

21. A transformable structure reconfigurable from an in-line configuration to a simulative configuration, characterized in that the transformable structure comprises:

a plurality of first beads each having a conical cavity positioned to radiate from a central through-hole to an aperture end;

a core member that passes through the through-holes to connect the plurality of first beads in series;

wherein a pair of the first beads are spaced from one another by a middle bead that has a through-hole, wherein a first end of the through-hole receives a first one of the pair of the first beads such that the aperture end of the conical cavity of the first one of the pair of the first beads is sized to fit entirely within the through-hole, wherein a second end of the through-hole receives a second one of the pair of the first beads such that the aperture end of the conical cavity of the second one of the pair of the first beads is sized to fit entirely within the through-hole.

22. The transformable structure of claim 21, characterized in that the core member comprises an elastic core member.

* * * * *